US005573330A

United States Patent [19]

Lucas

[11] Patent Number: 5,573,330

[45] Date of Patent: Nov. 12, 1996

[54] JOINING DEVICE FOR CHANDELIER ORNAMENTS

[75] Inventor: John M. Lucas, Cadyville, N.Y.

[73] Assignee: Schonbek Worldwide Lighting Inc., Plattsburgh, N.Y.

[21] Appl. No.: 491,264

[22] Filed: Jun. 16, 1995

[51] Int. Cl.[6] ..... F21S 13/06

[52] U.S. Cl. ..... 362/405; 362/806; 428/11; 428/542.2

[58] Field of Search ..... 362/405, 806; 403/170, 224, 367, 374; 428/11, 542.2

[56] References Cited

U.S. PATENT DOCUMENTS 3,049,897 8/1962 Arpels ..... 403/170

FOREIGN PATENT DOCUMENTS 1293964 4/1962 France ..... 362/806

1270677 4/1972 United Kingdom ..... 362/405

*Primary Examiner*—Stephen F. Husar

*Assistant Examiner*—Sara Sachie Raab

*Attorney, Agent, or Firm*—Wolf, Greenfield & Sacks P.C.

[57] ABSTRACT

A joining device for a chandelier ornaments provides a pair of retaining plates, typically cut from flat stock material, having ornaments located therebetween. The ornaments are secured against radial movement relative to the retaining plates by a series of retaining pins that pass through holes in the ornaments and holes in the plates. The plates are compressed so that it least one of the plates is in elastic deformation and the plates are secured to each other in a compressed, elastically deformed, state, by a grommet.

24 Claims, 12 Drawing Sheets

JOINING DEVICE FOR CHANDELIER ORNAMENTS

FIELD OF THE INVENTION

This invention relates to a joining device for chandelier ornaments and more particularly to a method and apparatus for forming a plurality of chandelier ornaments or trimmings into a single ornamental structure such as a star or flower.

BACKGROUND OF THE INVENTION

It is desirable in the construction of chandeliers to provide crystal ornaments in the form of stars, flowers or rings that can be, for example, mounted on the center post of the chandelier frame. Such stars, flowers or rings in the past were formed by attaching several individual crystal jewels or ornaments to a retaining structure formed of metal.

FIGS. 1 and 2 illustrate a star ornament structure according to the prior art. In this example, the centerpiece is formed from cast zinc or stamped steel. The centerpiece 20 is in the shape of a star. It is constructed from a pair of identical castings 22 and 24 that include respective pins 26 and 28 or projections. The pins are located and are sized to engage respective holes 30 in crystal ornaments 32. A crystal ornament 32 is located on each "point" 34 of the centerpiece 20. The crystal ornaments 32 are then held in a circular configuration by the identical castings 22, 24 which themselves are permanently joined. The resulting structure resembles a crystal flower or ring defined by a perimeter of crystal ornaments. The gap G between ornaments can vary depending upon the design. Likewise, the exact shape of the centerpiece 20 and ornaments 32 can be varied. The ornaments 32 can be disposed within a common plane, as illustrated in FIGS. 1 and 2, or can be formed into a bowl-shape or cone by varying the shapes of the top and bottom star sections. In particular, the angle of the ornaments can be changed by changing the angles of the respective walls 38 and 40 of the ornament pocket 42 defined between the two centerpiece halves 22 and 24.

In the example of FIGS. 1 and 2, the centerpiece halves 22 and 24 are held securely together by a grommet 46 that passes through the open center 48 of the star 20. The opposing ends of the grommet 46 are bent into radially-outwardly-facing lips 50 and 51 to overlap the inner perimeter faces 52 and 54, respectively, of each of the halves 22 and 24. The grommet 46 is also open at its center for mounting on a chandelier frame.

The ornament structure of FIGS. 1 and 2 is problematic and costly to manufacture. For a given set of identical ornaments, it is likely that one or more of the ornaments have mounting holes that are slightly different in shape and size. When each glass or crystal ornament is formed under high temperature, a punch pin, that is integral with the mold, pierces a mounting hole in a portion of the ornament. The intense heat of the molding process often burns away portions of the punch pin. The punch pin is occasionally replaced, due to erosion. But before replacement, a partially-eroded pin may have been used to form several of the ornaments in a given production run. Thus, for a given production run of ornaments, the hole sizes may be widely variable. Thus, the retaining pins 26 and 28 (FIGS. 1 and 2) of a given centerpiece can be oversized relative to some mounting holes. By forcing retaining pin into an undersized mounting hole, the ornament may break. Conversely, the retaining pins 26 and 28 may be too small to closely engage an oversized mounting hole. Thus, the ornament tends to wobble within the centerpiece, resulting in undesirable misalignment.

Even if the mounting holes and pins interengage precisely, breakage of ornaments can result during the cleaning process. Since the centerpiece halves are usually formed from non-resilient metal, application of excess pressure to the ornaments can cause the ornaments to break. Additionally, the use of solid metal centerpiece halves generally limits the applicability of the prior art joining process to machine-cut glass ornaments. This is because machine-cut glass ornaments are fairly uniform in thickness. Conversely, hand cut ornaments can vary greatly in thickness. The assembly process also requires the precision formation of two centerpiece halves. The centerpiece halves must be carefully filled with ornaments and aligned and the resulting halves must be joined together with a grommet. Application of too much joining force or misalignment of the halves can cause ornament breakage, leading to waste and excess manufacturing costs.

In view of the disadvantages of the prior art, it is an object of this invention to provide an improved joining device for chandelier ornaments that is easy to manufacture and assemble. The joining device should be formable by relatively-cost efficient stamping or cutting techniques without the need of complex casting or metal-forming processes. The structure should be versatile, enabling the mounting of a variety of shapes and sizes of ornaments without substantial risk of breakage. The structure should also hold a set of ornaments firmly despite minor variations in shape and mounting hole Size. The structure should also be easy to align for rapid assembly.

SUMMARY OF THE INVENTION

The invention involves an improvement to hub structures formed of two plates and adapted to capture and hold a plurality of crystal ornaments in a predetermined array. The improvement in one broad sense is the use of at least one elastically-deformable plate which can be compressed flexibly against the crystal ornaments to hold the ornaments in the predetermined array, the flexibility permitting securement even though the crystal ornaments may differ from one another with respect to one or more dimensions. In other words, the flexible plate conforms to variations in the size and/or surfaces of the crystal ornaments to capture all of the ornaments as desired.

A joining device for chandelier ornaments provides a pair of retaining plates that are typically formed into a series of arms with a central hub. The arms include holes for receiving pins. The holes can be aligned relative to each other or can be slightly misaligned relative to each other to provide resistance to the pins through the holes. An ornament, having a mounting hole, is interposed between each of the plates. One of the retaining plates is constructed from spring material, such as full hard 302 stainless steel. This spring material passage plate is elastically-deformable. Each pin is passed through the holes of each of the arms is also passed through the mounting hole of an ornament disposed in between the arms. The plates are compressed together by a grommet or other fastener that is typically passed through the central hub. The compression of the plates toward each other causes the arms of at least one of the plates to become elastically deformed and to firmly engage the side of the ornament. Since the sides of the ornament are usually angled, a radial component of force is transmitted to the ornament which forces the wall of the ornament mounting hole against the side of the pin. The resulting assembly firmly holds the ornament in a predetermined orientation relative to the plates. A series of ornaments can be disposed around the circumference of the hub generating a star, flower or other desired ornamental feature that employs a multiplicity of trimmings or ornaments.

The retaining plates can both be constructed from resilient material to generate a planar or slightly-bowl-like grouping of ornaments. Conversely, one of the retaining plates can be substantially rigid to generate, for example, a bowl-like shape. Similarly, a pair of resilient retaining plates can be located on each of opposing sides of a substantially-rigid plate to enable mounting of pairs of ornaments on each side of the substantially rigid plate. Thus, a two-tiered ornament structure can be formed.

Finally, by misaligning the adjacent mounting holes on each of a resilient plate and a substantially rigid plate, a pin passed through the mounting holes can be frictionally retained on each of the plater.

BRIEF DESCRIPTION OF THE DRAWINGS

The foregoing and other objects and advantages of the invention will become more clear with reference to the following detailed description as illustrated by the drawings in which.

DETAILED DESCRIPTION

Figure 1:
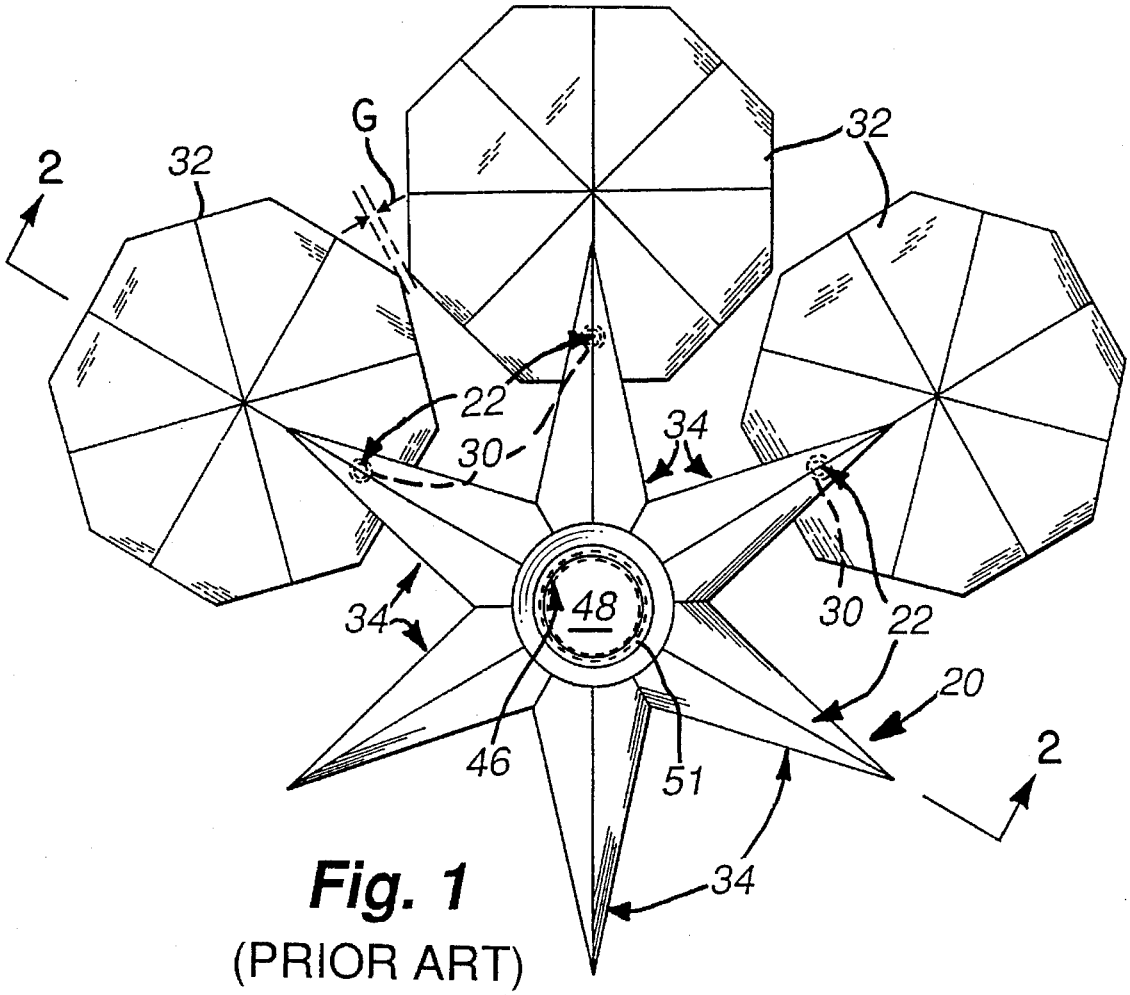
Fig. 1 (PRIOR ART)
FIG. 1 is a plan view of a partially-assembled ornament structure according to the prior art.
Figure 2:
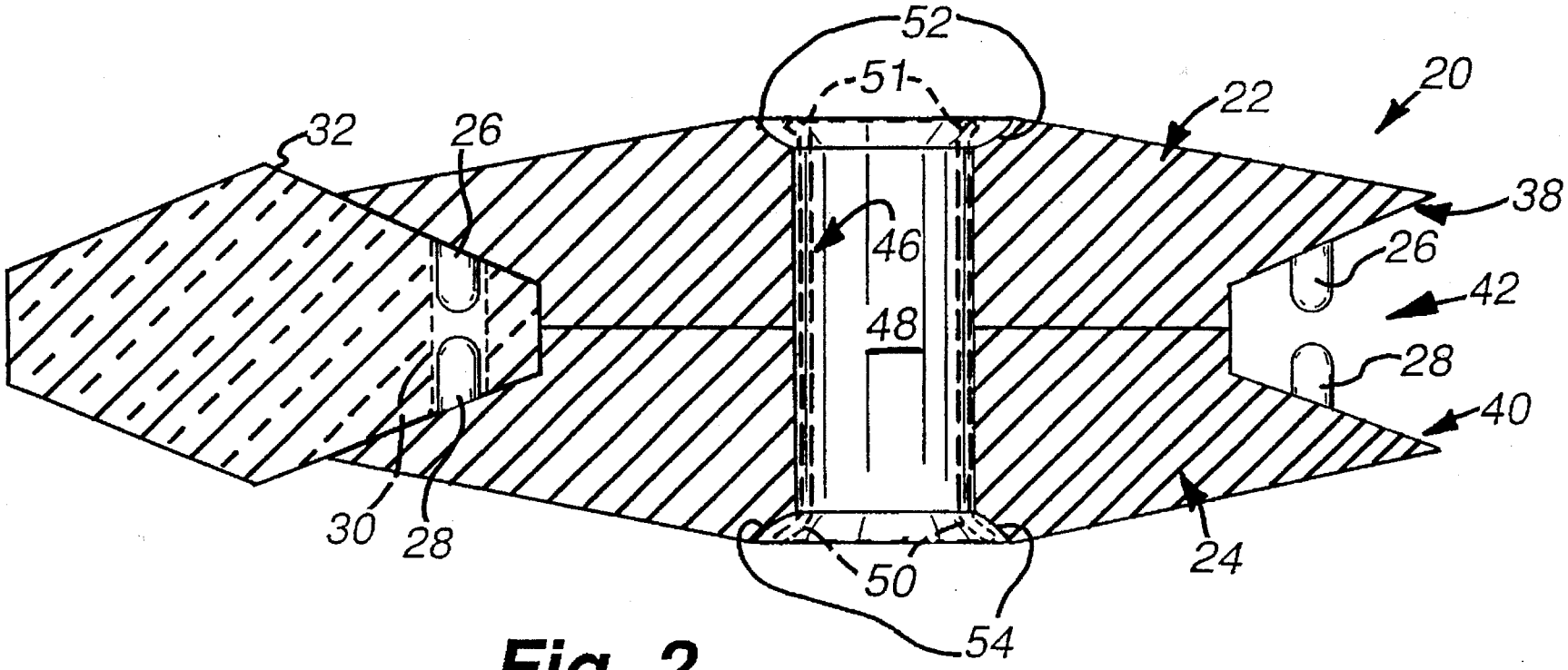
Fig. 2 (PRIOR ART)
FIG. 2 is a side cross section of the ornament structure taken along line 2—2 of FIG. 1.
Figure 3:
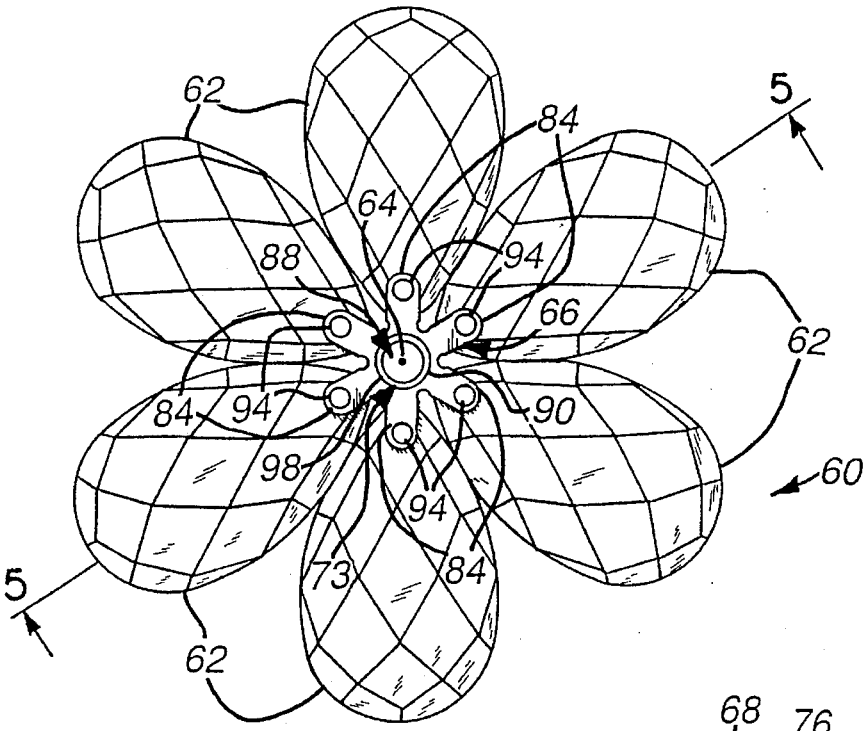
FIG. 3 is a plan view of an assembled ornament structure according to this invention.
Figure 4:
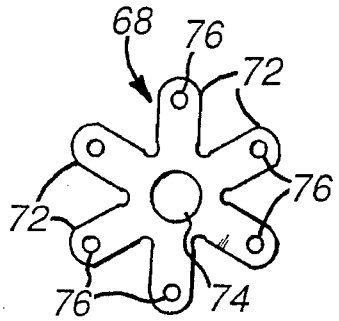
FIG. 4 is a plan view of a retaining plate for the ornament and structure according to this invention.
Figure 5:
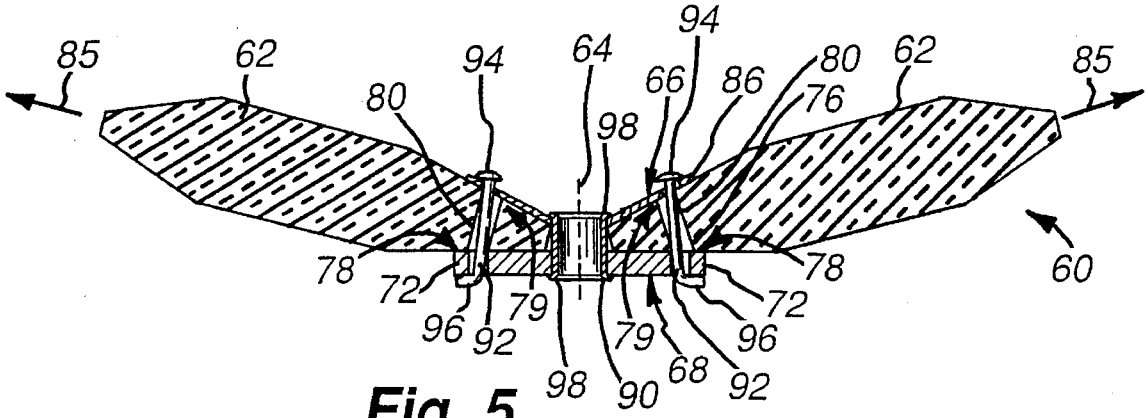
FIG. 5 is a side cross section of the ornament structure taken along line 5—5 of FIG. 3.

FIGS. 3, 4 and 5 illustrate a "star" or "flower" ornament structure 60 and its components according to an embodiment of this invention. The structure 60 comprises five crystal ornaments 62 that extend radially from a central axis 64 at approximately equal angular distances about the axis 64.

The ornaments 62 are retained by an upper retaining plate 66 and a lower retaining plate 68. The lower retaining plate 68 (FIG. 4) defines a series of arms 72 that radiate from a central opening 74. The retaining plate 68 can be constructed from any suitable rigid material such as mild steel having a thickness of approximately 0.059–0.074 inch. Each arm 72 includes a hole 76 that, in this embodiment, is approximately 0.058 inch. Each of the ornaments 62 include a pair of opposing flat, substantially beveled, surfaces 78 and 79 (FIG. 5). The lower beveled surface 78 enables each ornament to rest upon a corresponding arm 72 of the lower retaining plate 68 with the ornament angled upwardly relative to the plane of the retaining plate 68. The hole 76 on each of the arms 72 is located radially to coincide with corresponding through-cut holes 80 in each of the ornaments 62. According to this embodiment, the ornament holes 80 have a diameter of approximately 0.050 inch.

The upper retaining plate 66 secures the ornaments 62 in secure engagement with the lower retaining plate 68. In this embodiment, the upper retaining plate 66 (FIG. 3 ) includes a set of arms that are approximately equal in size and shape to the arms of the lower retaining plate 68. Each of the arms 84 includes a set of holes 86 (FIG. 5) that correspond in radial location to the holes 76 of the lower retaining plate 68. The holes 86 of the upper retaining 66 are also approximately 0.050 inch in diameter. The upper retaining plate 66 is constructed, preferably, from a material having sufficient resilience to induce a spring force upon elastic deformation. In this embodiment, a spring or stainless steel having a thickness of 0.015 inch is utilized. In particular, "full hard" 302 stainless steel can be utilized.

The upper retaining plate 66 also includes a through-cut central hole 88 that is centered about the central axis 64. The central holes 74 and 88 of the lower retaining plate 68 and upper retaining plate 66, respectively, receive a grommet 90 that, in this embodiment, can comprise a brass eyelet having a diameter approximately equal to that of the central holes. The grommet has an open center for each of mounting on a chandelier frame. This open center can receive a screw or center rod and can form the base for a bead or other center trimming. The attachment of the grommet 90 is described further below. The grommet 90 secures the upper retaining plate 66 and lower retaining plate 68 together along the direction of the axis 64. The grommet 90, thus, imparts axial compression between the upper and lower retaining plates 66 and 68 that provides a primary securing force for the ornament 62.

The upper retaining plate 66 and lower retaining plate 68 can each be constructed from flat sheet material, the plates can be formed into a variety of geometric patterns as described further below. According to a preferred embodiment, the plates can be constructed giving a commercial laser cutting device that can include a variety of punches for generating holes and corner cuts. The cutting pattern used by the laser cutter, can be provided by a computer aided design/computer aided manufacturing (CAD/CAM) program that optimizes uses of a piece of sheet stock.

Each of the ornaments 62 is individually secured relative to a set of retaining plate arms 72 and 84 by retaining pins 92. The pins 92 pass through the upper retaining plate holes 86, the ornament holes 80 and the lower retaining plate holes 76. The pins retain the ornaments 62 against movement in a radially-outward direction, as described further below. The pins, according to this embodiment, comprise 0.7 mm soft brass pins that are easily-formable, but that hold their shape once deformed. The pins 92 include a head 94 that bears against each of the upper retaining plate arms 84. The lower end 96 of each pin 92 is bent around the lower retaining plate hole 76 to retain the ends of the pins 92 within the retaining plates 66 and 68. As described further below, the retaining pins 92 of this embodiment can be substituted with a variety of projections that engage ornament holes. The projections can engage both the upper and lower retaining plates and pass fully through the mounting hole, or can project only partially through the mounting hole and engage only one of the upper and lower retaining plates. The projections of this invention are utilized primarily to restrain the ornaments against slidable misalignment relative to the retaining plates.

As detailed in FIG. 5, the resulting retaining plate structure secures each of the ornaments 62 in a compressed relationship between the arms upper retaining plate 66 and the arms of the lower retaining plate 68 with radially-outward acting force on the ornaments 62 restrained by the pins 92. The arms conform to the angles of the ornaments beveled surfaces 78 and 79 under composition. The angles, thus, generate a radially acting component of force (arrow 85) that bears upon the pins 92. This force enhances ornament security. The pins 92 are also misaligned relative to the ornament holes 80 inducing a slight deflection (not visible) in the pins 92. The deflection serves to further secure the pins within the holes 80.

Construction of a star ornament 60 according to this embodiment is relatively simple. Ornaments 62 are aligned relative to the lower retaining plate 68. The upper retaining plate 66 is located over the ornaments. The holes 86 and 76 of the upper retaining plates 66 and lower retaining plates 68, respectively, are aligned with the holes 80 of the ornaments 62. The pins 92 are passed through the holes 86, 80 and 76 and the ends 96 of the pins 92 are bent to secure pins in place. A grommet 90 is passed through the upper retaining plate hole 73 and the lower retaining plate hole 74 and the ends 98 of the grommet 90 are swaged as the upper retaining plate 66 is forced into close contact with the beveled surface 79 of each of the ornaments 62. The downward-forcible-compression of the plate 66 causes the plate arms 84 to bend upwardly. The upward bending induces a spring force into the arms that bear down onto the beveled surface 79. The resulting structure is very secure with each of the ornaments 62 held in compression against the upper and lower plates 66 and 68 on their respective beveled surfaces 79 and 78.

It is contemplated that a variety of retaining plate structures and grommets can be utilized according to the invention. For example, a screw or rivet can be substituted for the grommet 90. Likewise, rivets, cotter pins, screws or other fasteners can be utilized as substitutes for the pins 92. Additionally, while retaining plates having a series of radial arms are shown, a variety of plate shapes can be utilized. For example, a star-shaped retaining plate can be utilized. A larger armless plate can also be utilized as a substitute for the lower retaining plate 68. Additionally, a second resilient retaining plate can be located on the lower plate 68 opposite the upper plate 66 to generate a two-tiered ornament structure. In this embodiment, it is contemplated, primarily, that at least one plate be rigid while another plate is elastically deformable to compress against a portion of the ornaments.

Figure 6:
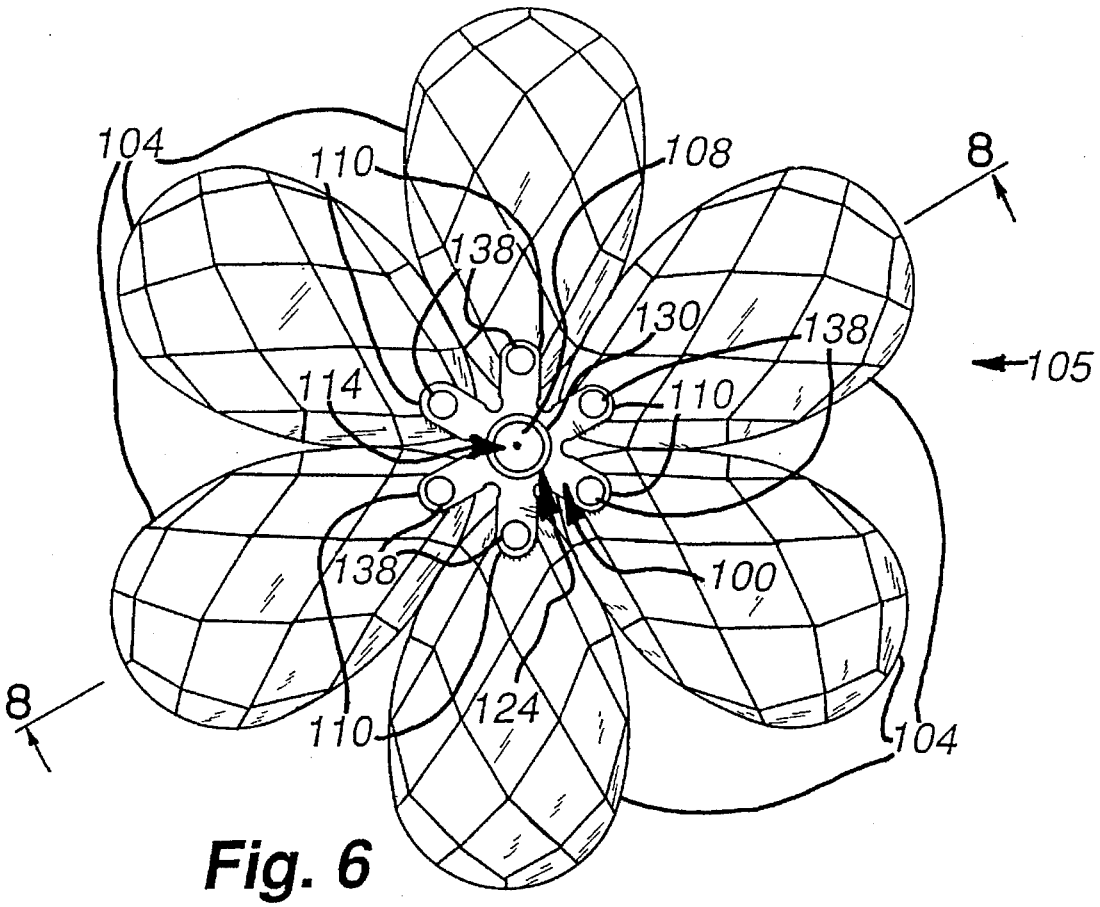
FIG. 6 is a plan view of a another embodiment of an assembled ornament structure according to this invention.
Figure 7:
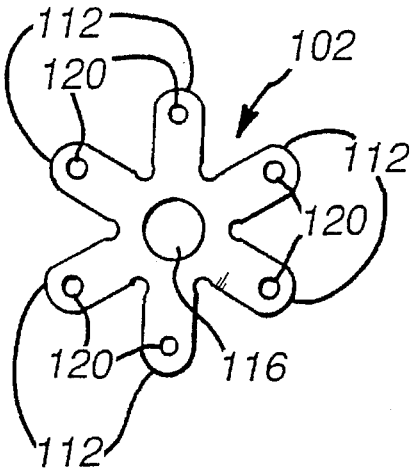
FIG. 7 is a plan view of a lower retaining plate for the ornament structure of FIG. 6.
Figure 8:
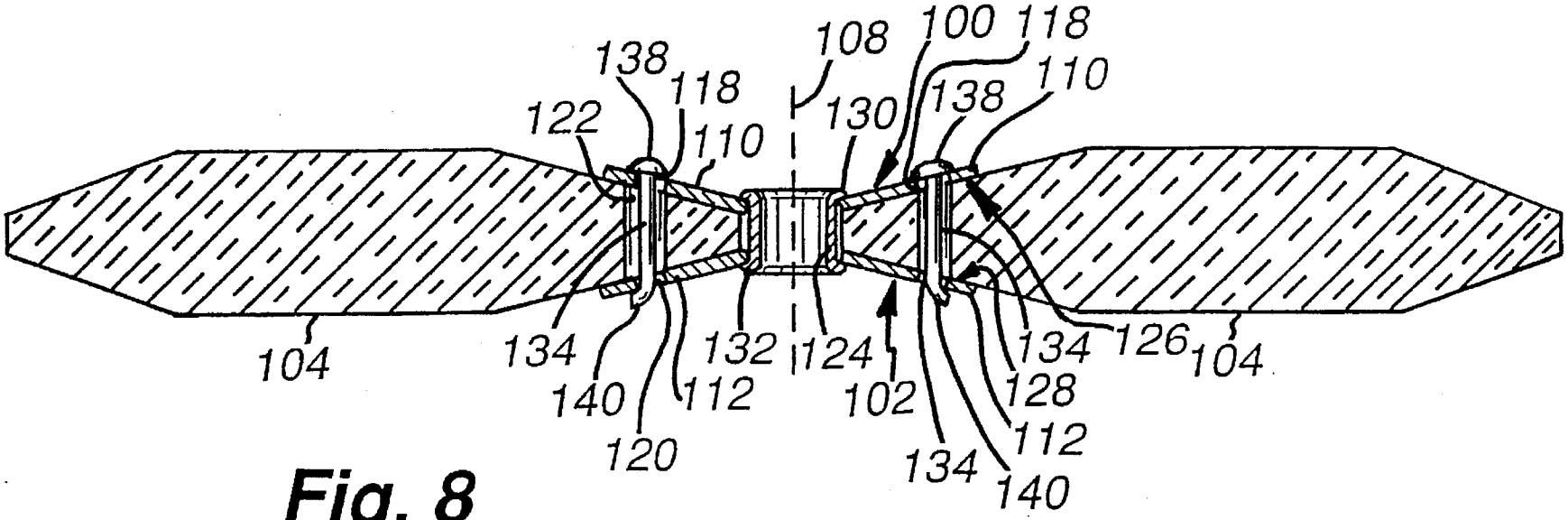
FIG. 8 is a side cross section of the ornament structure taken along line 8—8 of FIG. 6.

FIG. 6–8 illustrates another embodiment according to this invention in which both the upper and lower retaining plates 100 and 102 are substantially-identical in shape, size and are both formed of spring material. The plates 100 and 102, hence, generate a substantially-planar star ornament structure 105. The ornament structure 105 is constructed from six ornaments 104 that project radially outwardly from the center axis 108. The plates 100 and 102 each include a series of arms 110 and 112, respectively, that extend radially from a center hole 114 and 116, respectively. Each of the upper and lower retaining plates 110 and 112, in this embodiment, are constructed from a spring material that, in this embodiment, can comprise 0.015 inch full hard 302 stainless steel or a similar elastically-deformable material. Each of the arms 110 and 112 includes a respective hole 118 and 1201 The holes, in this embodiment, are approximately 0.058 inch in diameter. The holes 118 and 120 are aligned relative to respective holes 122 in each of the ornaments 104.

As detailed in FIG. 8, the upper and lower plates 100 and 102 are compressed by a grommet 124 so that the arms 110 and 112 are brought into close-engaging contact with the upper and lower beveled surfaces 126 and 128, respectively, of each ornament 104. The grommet 124 is secured to the upper and lower plates 100 and 102 by a pair of opposing swaged ends 130 and 132. Each ornament 1041is secured relative to the arms 110 and 112 by a pin 134 that passes through each of the holes 118 and 120 in the upper and lower plate arms 110 and 112, respectively. Each pin 134 also passes through a corresponding hole 122 in each ornament 104. The pins, in this embodiment, comprise a 0.7 mm soft brass pin having a head 138 and a bent lower end 140. Each pin 134 prevents radially-outward extension of its respective ornament 104. Since the upper and lower retaining plates 100 and 102 are approximately equal in size and shape, the spring forces generated by these plates are also approximately equal. As a result, forces on each ornament 104 are in approximate equilibrium and the ornaments assume a substantially planar shape (FIG. 8).

It is contemplated that the spring constants and/or sizes of the plates can be varied to generate an angled (bowl-shaped) ornament structure rather than a substantially-planar structure as detailed. Construction of such a structure is substantially identical to that described for the embodiment of FIGS. 3–5. Construction of the ornament structure according to this embodiment differs from that of FIGS. 3–5, because both the upper and lower retaining plates have spring-like characteristics. Hence, the grommet must be formed so that both the upper and lower retaining plates are fully deformed against the beveled surfaces 126 and 128 of the ornaments 104.

Figure 9:
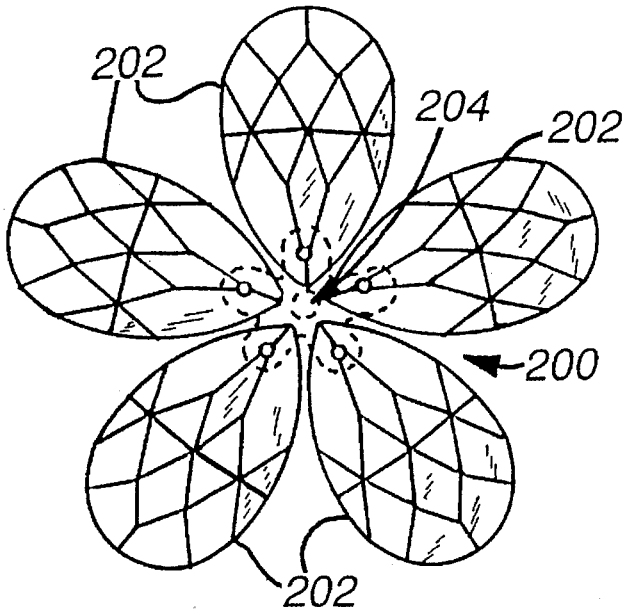
FIGS. 9–14 are plan views of a variety of cut crystal ornament patterns that can be assembled utilizing the retaining plate structure according to this invention.

The retaining structures described in FIGS. 3–5 and 6–8 can be applied to a variety of ornament structures having different sizes, shapes and numbers of ornaments. To construct a given "star" or "flower" ornament structure, the number of arms (or other hole-carrying structures) on the retaining plate should correspond to the number of ornaments. In particular, the number of holes formed in a retaining plate should equal the number of holes presented on the ornaments. Each ornament should have at least one hole to be properly retained. FIGS. 9–14 details some examples of star ornament structures that can be constructed using the retaining structures described in FIGS. 3–5 and 6–8. The retaining structure illustrated for each set of ornaments can be constructed according to the embodiment of FIGS. 3–5 or according to the embodiment of FIGS. 6–8. Each retaining structure is shown in phantom for improved clarity. FIG. 9 shows a structure 200 having five ornaments 202 with a teardrop shape. The retaining plates 204 in this embodiment form a five-armed structure.

Figure 10:
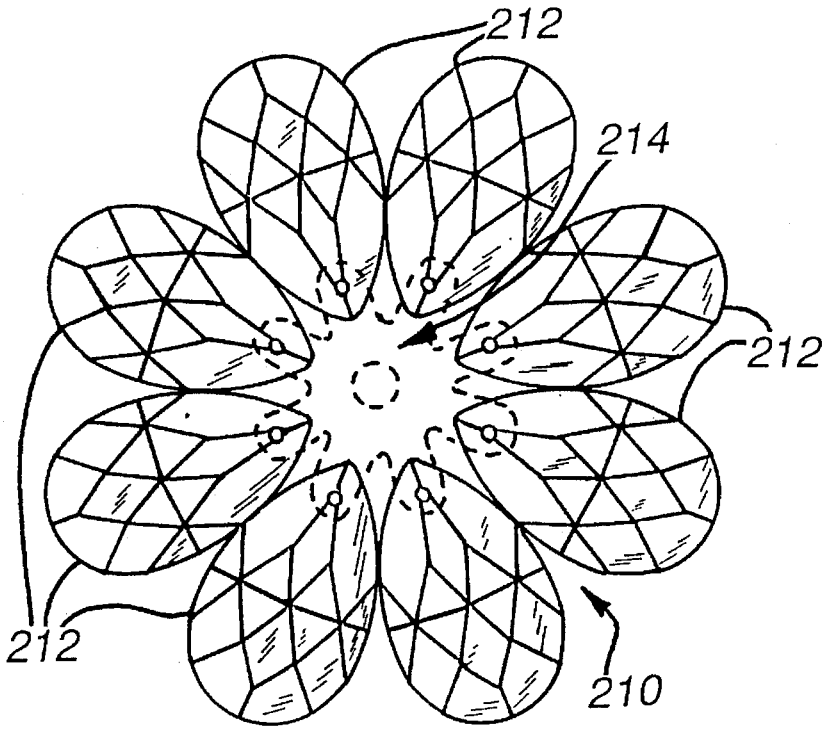

FIG. 10 shows an ornament structure 210 having eight ornaments 212 of teardrop shape, the ornaments 212 are retained by an eight-armed retaining plate structure 214.

Figure 11:
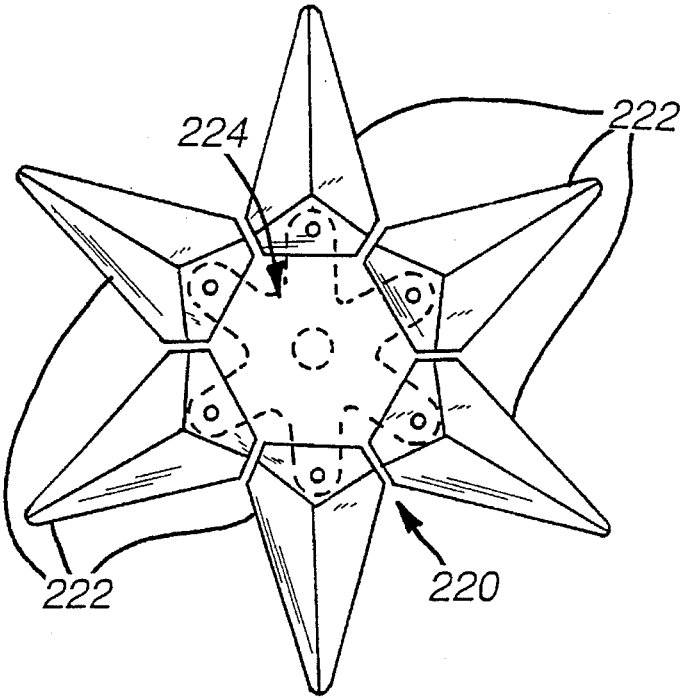

FIG. 11 shows an ornament structure 220 having six ornaments 222 that each define a point of a star. The ornaments 222 are retained by a six-armed retaining plate structure 224.

Figure 12:
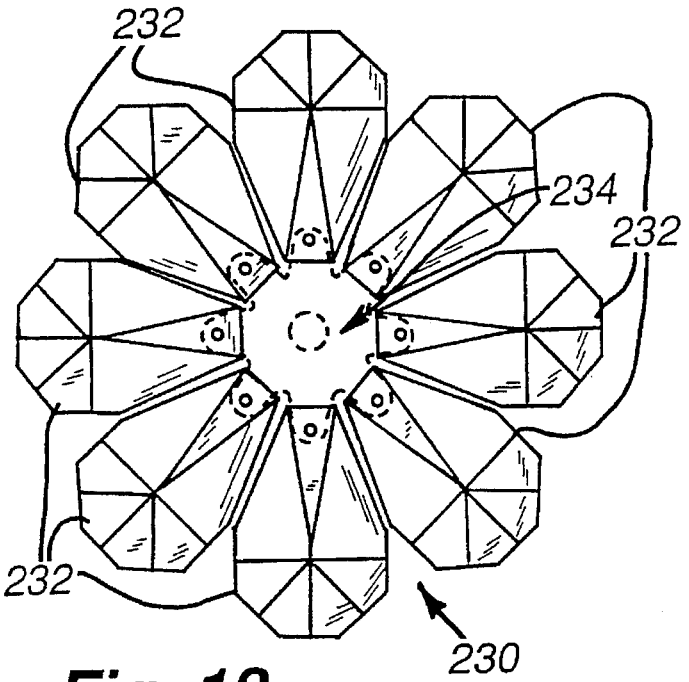

FIG. 12 shows an ornament structure 230 having eight ornaments 232 each defining a polygonal outline. The ornaments 232 are secured by an eight-armed retaining plate structure 234.

Figure 13:
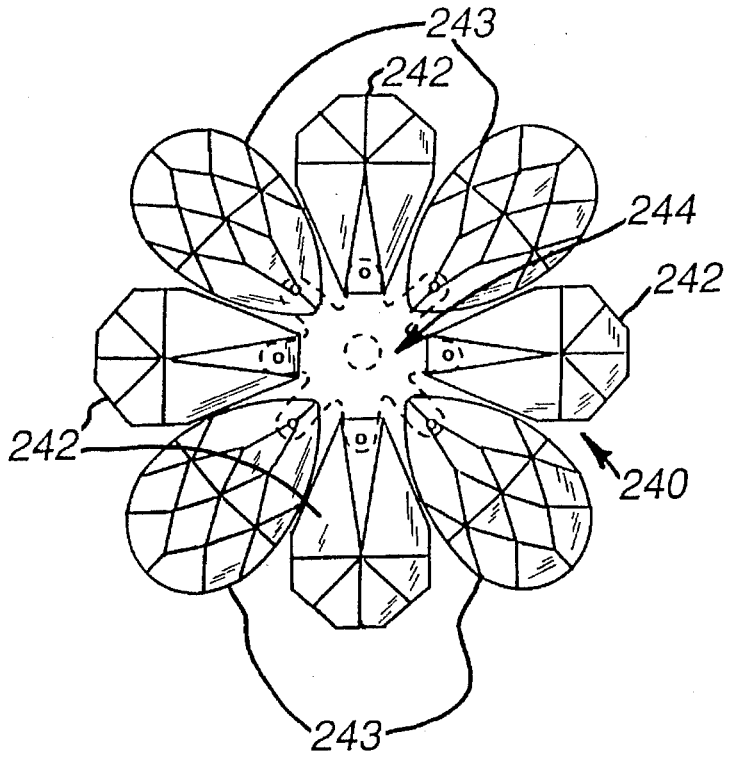

FIG. 13 shows an ornament structure 240 constructed from two sets of four ornaments 242 and 243 that comprise polygonal (242) and teardrop (243) shapes in an alternating circumferential pattern. A variety of different types and shapes of ornaments can be combined within a single star ornament structure. In the embodiment of FIG. 13 an eight-armed retaining plate structure 244 secures the combination of ornaments 242 and 243.

Figure 14:
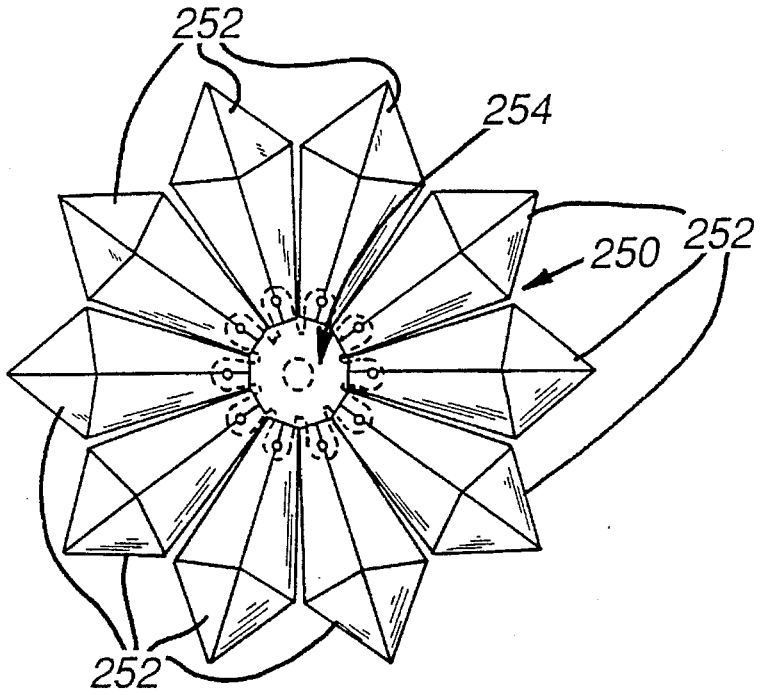

FIG. 14 shows an ornament structure 250 having ten narrow ornaments 252 secured by a ten-armed retaining plate 254. Each of the ornaments 252 is located in close circumferential engagement with its adjacent ornaments. This enables a dense packaging of ornaments in a single star structured 250.

The resilient retaining plate structures described herein, can each be formed as a series of arms. The arms can have rounded ends or can be formed with a geometric outline. The width and length of each arm can be varied depending upon the amount of elastic deformation which the arm experiences. A more-deformed arm should be more narrow and longer, while a less-deformed arm can be wider or shorter. The radially-inwardly-located portion of the arm can be more narrow than the more-radially-outwardly located portion since more bending occurs near the center of a retaining plate. Thus, arms can have the shape of the legs of a "maltese cross." A width (perpendicular to a direction of radial extension) of approximately 3–4 mm and a length (along a direction of radial extension) of approximately 15 mm should enable an arm to bend sufficiently for the embodiments described herein. Other arm lengths and widths can be provided to various ornament configurations and ornament size. Such lengths and widths can be determined on a trial-and-error basis by applying a given retaining structure to a set of ornaments and resizing the arms until proper security is attained.

While the holes of the upper and lower retaining plates, according to this invention, are generally aligned relative to each other, it is contemplated that the holes can be misaligned relative to each other by several thousandths of an inch when both plates are flat and undeformed. Such misalignment can be used to enhance the security of the ornaments when the plates are compressed relative to each other. The misalignment of holes can force a retaining pin against the walls of the ornament hole and provide further retaining force to hold the pins in place and prevent them from backing out of their respective holes.

Figure 15:
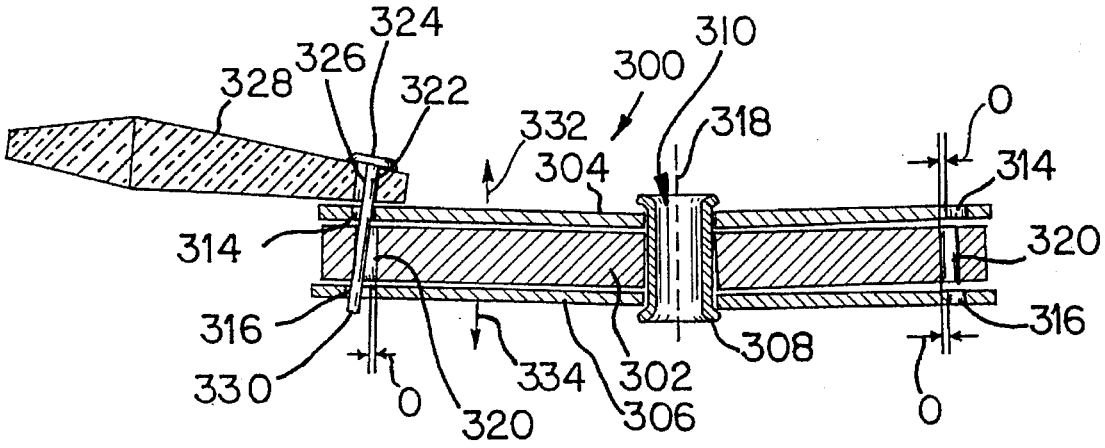
FIG. 15 is a side cross section of an ornament retaining structure according to another embodiment of this invention.

An embodiment that utilizes the misalignment of plate holes as a primary retaining force is detailed in FIG. 15. The retaining structure 300 according to this embodiment comprises a rigid central plate 302 and a pair of upper and lower retaining plates 304 and 306, respectively. The central retaining plate can be constructed from mild steel having a thickness of approximately 0.59–0.74 inch. The upper and lower retaining plates 304, 306 can be constructed from 302 full hard stainless steel or another flexible material. The plates 302, 304 and 306 are joined at their center by a grommet 308. The grommet 308 holds the plater 302, 304 and 306 in axial compression. The plates 302, 304 and 306 are not elastically deformed relative to each other by the grommet 308. Rather, each of the plates lays flatly upon the other in a face-to-face relationship. The plates can be constructed with arms or, conversely, can be constructed as a continuous geometric shape, such as a circle, oval or polygon. The grommet 308 can include an open center 310 that can serve as a mounting hole or as a location for a bead or other trimming.

1. The upper and lower plates 304 and 306 include respective holes 314 and 316. In this embodiment, the holes 314 and 316 are each disposed a substantially identical distance from the center axis 318. Likewise, the central plate 302 includes holes 320. In this embodiment, the holes 320 are slightly closer to the central axis 318 than the upper and lower plate holes 314 and 316, respectively. The difference in distance from the central axis is characterized as an offset O. In this embodiment, the offset O is approximately 0.01 inch. A pin 322 having a head 324 is driven through each of the holes 314, 316 and 320. The pin also passes through a corresponding hole 326 in a crystal ornament 328. The head 324 is oversized relative to the hole 326 and, thus, prevents further passes of the pin 322 through the hole 326. The pin 322, according to this embodiment, is a 0.7–0.8 mm pin constructed from steel or brass having a pointed or blunted lower end 330. Each hole is approximately 0.058 inch, according to this embodiment. When a pin is passed through an ornament and into the holes 314, 320 and 316 of the plates, it encounters resistance due to the misalignment or offset O of the plate holes 314, 320 and 316. The blunted end 330 enables the pin 322 to pass from hole-to-hole. Since the upper and lower plates 304 and 306 are constructed from a flexible spring material, they tend to flex or buckle (arrows 332 and 334) in response to the passage of the pin 322. Only a slight buckling occurs, but it is sufficient to provide substantial resistance to the side of the pin 322 by the side wall of each hole. As such, once the pin. has passed through each of the plates, it is held firmly by spring action of the upper and lower plates bearing against its side, and forcing the pin into contact with the sidewall of the central plate hole.

The securing strength of the retaining structure 300 according to this embodiment can be enhanced by providing grooves or notches to the pin that engage the upper, lower and/or central plates hole sidewalls. Conversely, the retaining structure according to this embodiment can be constructed with a single rigid and a single flexible plate. It is desirable that the holding strength, in a single flexible plate embodiment, be sufficient to prevent a pin from releasing under normally-encountered pressure such as wind, vibration and light handling. Thus, additional notches or grooves on the pin surface may be required. Likewise, it is contemplated that ornaments can be located on both surfaces of the retaining structure according to this embodiment.

Figure 16:
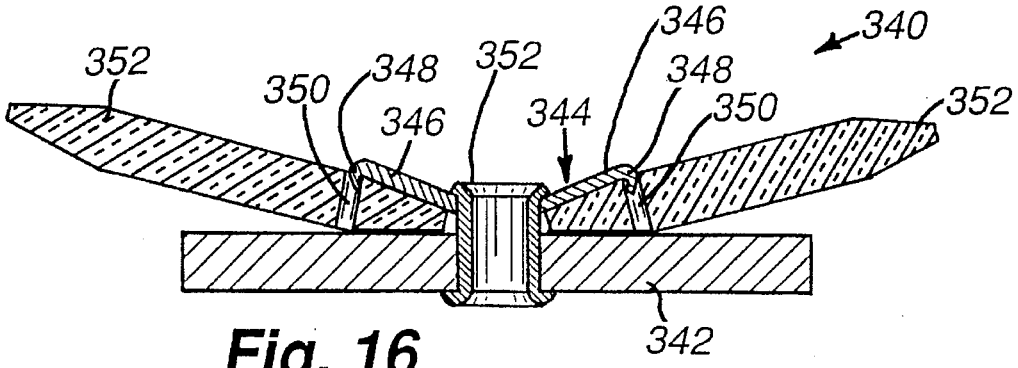
FIG. 16 is a side cross section of an ornament structure according to another embodiment of this invention.
Figure 17:
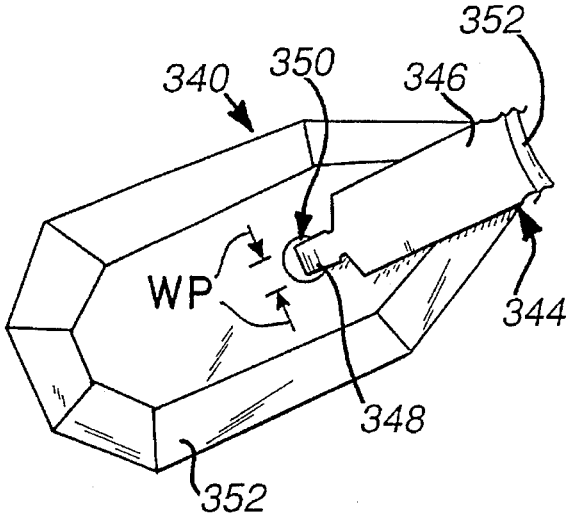
FIG. 17 is a partial plan view of the ornament structure of FIG. 16.

While each of the preceding embodiments utilizes a separate retaining pin that engages a mounting hole of an ornament, it is contemplated that another form of projection can be utilized to engage respective mounting holes of ornaments according to this invention. FIGS. 16 and 17 illustrate an embodiment in which an ornament structure 340 is secured by a rigid lower retaining plate 342 and a flexed upper retaining plate 344 having arms 346 with integral end projections 348. The end projections 348 have a narrowed width WP relative to the width of the arm 346. The width WP is chosen so that the projection 348 fits within a mounting hole 350 of an ornament. The projection 348 acts similarly to a pin and retains the ornament 352 against radially-outward movement under the spring force of the upper plate 344. Note that the projection 348 only extends partially into the mounting hole 350. The length of the projection 348 can vary depending upon the thickness of the ornament and other factors. The exact length of the projection can be chosen on a trial-and-error basis by applying differing-length projections to ornaments until an acceptable level of security is obtained. This embodiment is also illustrative of an embodiment in which the projection only engages one of the two opposing retaining plates. It is contemplated that the projection can, conversely, be formed in the lower retaining plate 342. Likewise, projections in both the upper and lower retaining plates 344 and 342, respectively, can be utilized to secure each ornament. It is contemplated primarily that the projections limit radial movement of the ornament under the spring force of the retaining plate 344.

Construction of an ornament structure 340 according to FIGS. 16 and 17 involves the formation of a lower retaining plate 342 and a corresponding upper retaining plate 346 from flat material. As noted above, the upper retaining plate 344 is formed with a series of arms 346 having end projections 348, from spring material. The end projections 348 are formed as flat extensions of the arm 346. Prior to assembly, the end projections 348 are bent permanently downwardly to form hooks as detailed in FIG. 16. The upper plate 344 and lower plate 342 are aligned relative to each other with the hooks engaging respective mounting holes 350 of each of the ornaments. A grommet 352 or other axially-acting fastener is then used to compress the upper plate 344 against the ornaments 352 to generate a spring force.

It is further contemplated that a pair of opposing, felexible, retaining plates such as the upper retaining plate 344, having end projections 348 can be used on either side of a set of ornaments to generate a substantially-flat ornament as detailed in FIGS. 6–8. At least one of the plates should include end projections 348. However, in some embodiments, it is preferred that both the upper and lower flexible plates include such end projections.

Figure 18:
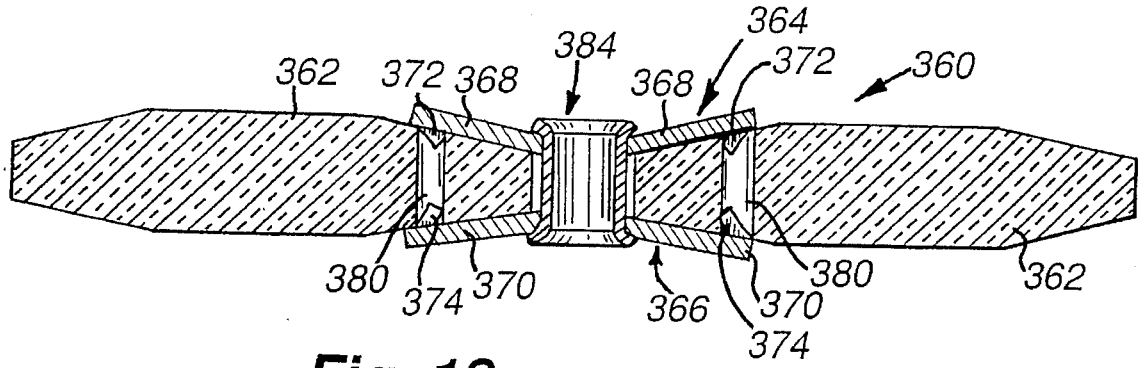
FIG. 18 is a side cross section of an ornament structure according to another embodiment of this invention.
Figure 19:
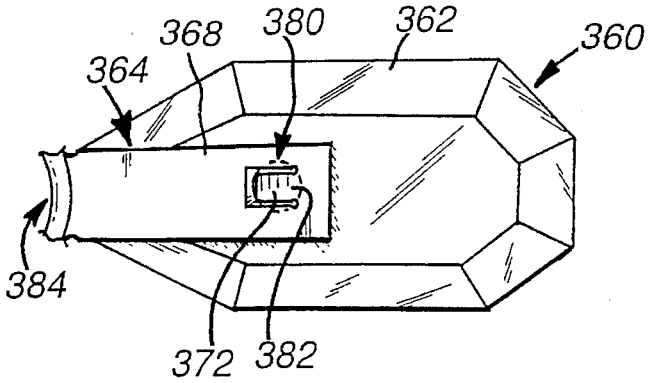
FIG. 19 is a partial plan view of the ornament structure of FIG. 18.

FIGS. 18–19 illustrate an alternate embodiment of an ornament structure 360 in which a set of ornaments 362 are secured between upper and lower flexible plates 364 and 366, respectively. The resulting ornament structure is substantially planar or flat. Each of the upper and lower plates 364, 366 include a series of arms 368 and 370, respectively, having integral projections 372 and 374, respectively. The projections, in this embodiment, are sized in width to engage respective mounting holes 380 in each of the ornaments. The projections 372 and 374 in this embodiment are formed by cutting three sides of a rectangle within a central portion of the arm 368. A fourth side of the rectangle (in this embodiment the radially-outward-most side 382) remains uncut and each of the projections are folded along the uncut side 382. The projections 372 and 374, thus, form hooks that resist radially-outward movement (e.g. "slidable misalignment of the ornaments 362 relative to the plates 364 and 366.

Construction of an ornament structure 360 according to this embodiment involves the location of each of the ornaments 362 between each of the plates 364 and 366 with respective hooks 372 and 374 engaging opposing sides of each ornament hole 380. The hooks 372 and 374 are typically formed by permanent bending of the respective plates 364 and 366 after the plates are cut from flat spring stock. The plates 364 and 366 are then compressed to conform to the sides of the ornament by applying a swaged grommet 384 or other fastening structure. The ornaments 362 move radially outwardly under the spring force of the plates 364 and 366 to engage the hooks. It is contemplated that one of the fastening plates 364 and 366 can also be used in conjunction with the rigid plate according to this invention.

Figure 20:
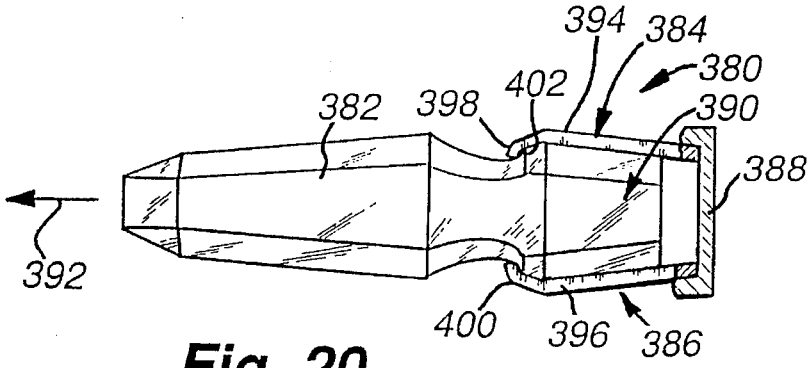
FIG. 20 is a partial side cross section of an ornament structure according to another embodiment of this invention.
Figure 21:
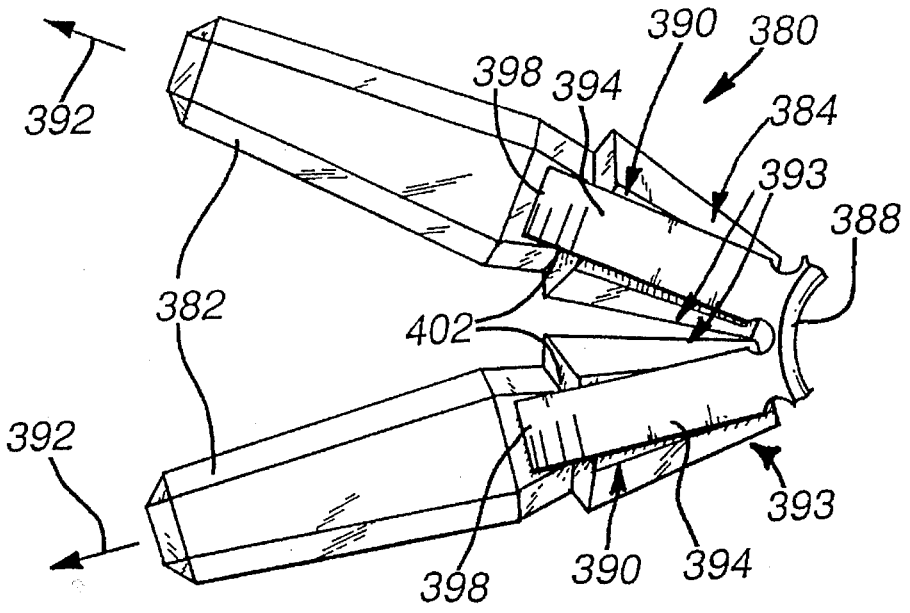
FIG. 21 is a partial plan view of the ornament structure of FIG. 20.

Each of the preceding embodiments relates to the retention of ornaments by engaging an ornament mounting hole with a projection that retains the ornament against radially-outward movement relative to the retaining plates. FIGS. 20 and 21 illustrate an ornament structure 380 in which each ornament 382 is free of mounting holes. The structure 380 according to this embodiment includes an upper retaining plate 384 and a lower retaining plate 386 that are compressed to generate a spring force by a grommet 388. Since the inner portion 390 of the ornament 382 is beveled in a direction toward the grommet 388, the compressed plates 384 and 386 generate a radially-outwardly acting force (arrow 392). Thus, the ornament 382 is driven by the plates 384, and 386 in a radially-outward direction. The respective arms 394 and 396 of each plate 384 and 386, respectively, include perpendicular shoulders 398 and 400, respectively, that engage a corresponding rim 402 on the ornament 382 and capture the ornament 382 between the two plates 384 and 386. Thus, the rim 402 is restrained from further radially-outward movement (arrow 392). As detailed in FIG. 21, the rear portion 390 of each ornament closely abuts each adjacent ornament along its side edges 393 and, hence, the ornaments in this embodiment are also restrained against lateral (side-to-side) movement within the structure 380. It is contemplated that the arms 394 and 396 according to this embodiment can also include side stops to prevent lateral movement of ornaments. When such side stops are employed, the rear portions 390 of each ornament 382 need not closely abut one another.

Construction of an ornament according to the embodiment of FIGS. 20–21 entails the placement of a series of ornaments between the upper and lower plates 384 and 386 with an ornament 382 adjacent each of the arms 394 and 396, respectively. The plates 384 and 386 are then compressed to generate a spring force against the rear portion 390 of each ornament 382. The compression is maintained by joining the plates with a grommet 388 or other axially-acting fastener.

It is contemplated that one of the flexible plates 384 and 386 can be substituted with a rigid plate according to this invention. A stop can be provided on the rigid plate, the flexible plate or both to limit radial movement of the ornament 382. The placement of stops can be chosen on a trial-and-error basis depending upon the size and shape of the ornament.

Figure 22:
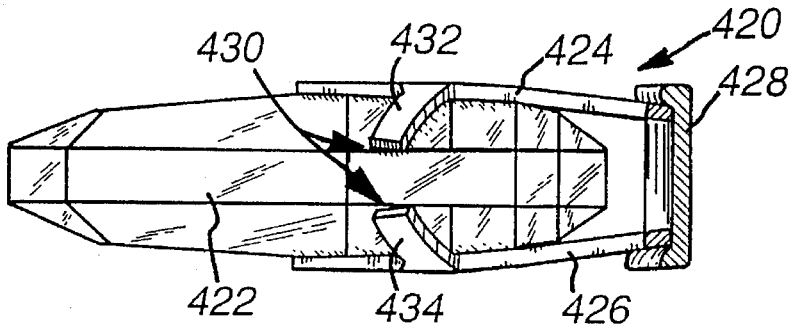
FIG. 22 is a partial side cross section of an ornament structure according to another embodiment of this invention.
Figure 23:
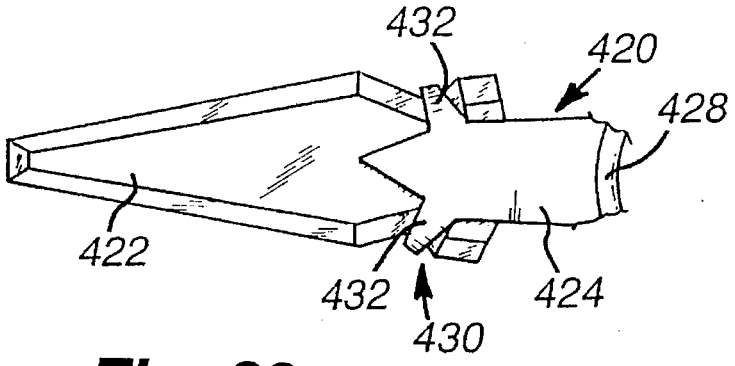
FIG. 23 is a partial plan view of the ornament structure of FIG. 22.

FIGS. 22–23 illustrate a portion of an ornament structure 420 according to another embodiment of this invention. This embodiment also utilizes ornaments that are free of mounting holes. The ornament 422 is captured between a pair of retaining plate arms 424 and 426 that are held in compression by a grommet 428. The ornament includes a neck portion 430 that receives a pair of opposing side stops 432 and 434 on each of the arms 424 and 426, respectively. The side stops maintain the ornament against radially-outward movement of the 422 and also prevent lateral movement of the ornament 422 traversely to the radial direction.

Construction of the ornament structure 420 according to this embodiment entails the location of a series of ornaments 422 so that their necks 430 are adjacent the side stops 432 and 434 of each arm 424 and 426, respectively. The arms 424 and 426 are typically formed as part of a flat spring material piece and the side stops 432 and 434 are permanently deformed so that they project outwardly relative to the plane of the arms. The angle of bend and size of stops 432 and 434 depends upon the size and shape of ornament to be secured. The stops should closely conform to the ornament when it is positioned in a desired orientation. When each ornament is positioned relative to the side stops 432 and 434, the arms are compressed into an elastically deformed state by the grommet 428 or a similar axially-acting fastener. It is contemplated that one of the plates according to this embodiment can be substituted with a rigid plate and that side stops can be located on either the rigid plate, the flexible plate or both plates. Similarly, in the embodiment of FIGS. 22–23, side stops can be located on only one of the two opposing arms 424 and 426 according to this invention.

Figure 24:
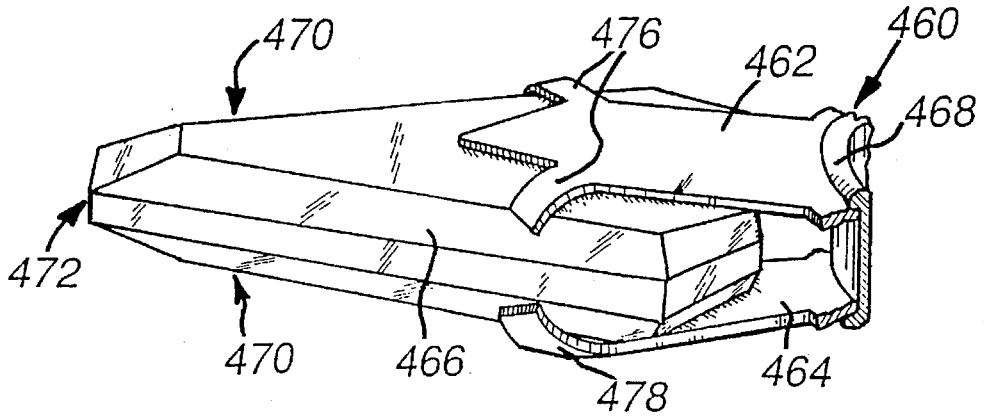
FIG. 24 is a partial perspective view of an ornament structure according to another embodiment of this invention.
Figure 25:
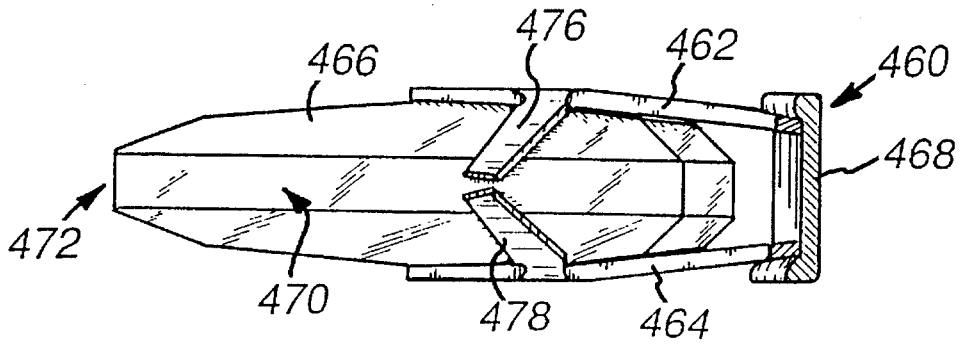
FIG. 25 is a partial side cross section of the ornament structure of FIG. 24.
Figure 26:
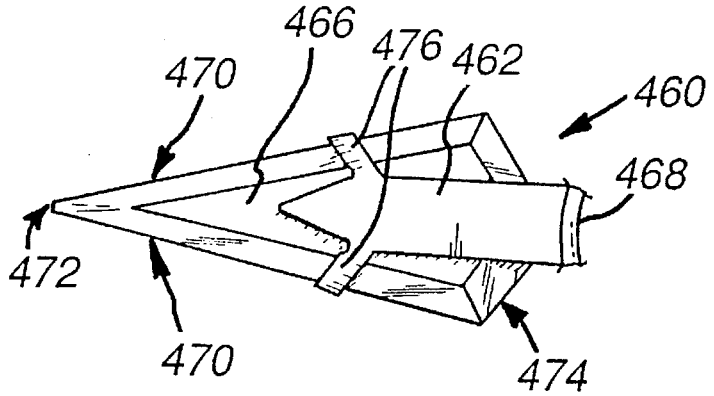
FIG. 26 is a partial plan view of the ornament structure of FIG. 24.

Finally, the embodiment of FIGS. 24–26 illustrate the retention of an ornament that is both free of mounting holes and of a specialized shoulder, rim or neck structure. In other words, FIGS. 24–26 illustrate the mounting of a more-conventionally-shaped ornament. The structure 460 includes a pair of flexible retaining plate arms 462 and 464 that capture an ornament 466 therebetween. The arms 462 and 464 are forced into elastic deflection by a grommet 468. The ornament 466 according to this embodiment is defined by a pair of elongated sides 470 that terminate in a steeply-angled tip 472. The rear portion 474 of the ornament 466 is very short relative to the sides 470. The arms 462 and 464 include permanently-deformed side stops 476 and 478, respectively, that engage the sides 470 of the ornament 466. The side stops 476 and 478, thus, bear upon the ornament sides 470 and prevent radially-outward movement of the ornament 466 beyond maximum position. By constructing the side stops 476 and 478 with sufficient stiffness, and by controlling the angle at which the side stops 476 and 478 project from the plane of their respective arms 462 and 464, the location of each ornament 466 relative to the arms 462 and 464 can be accurately maintained.

The structure 460 according to this embodiment is constructed in a manner similar to the structure 420 of the embodiment of FIGS. 22–23. Ornaments 466 are positioned between respective arms 462 and 464 after side stops 476 and 478, respectively, have been permanently deformed to project out of the planes of each of the arms 462 and 464. The arms 462 and 464 are then compressed to generate a spring force by securing a grommet 468 to the center of the arms. Since the ornaments according to this embodiment typically rely upon a firm engagement between the side stops 476 and 478 and the ornament sides 470, the generation of a radially-outwardly-acting spring force is desirable. Thus, it is preferred that the ornaments 466 have an inwardly beveled rear portion that causes the arms 462 and 464 to generate a sufficiently strong, radially-outwardly-acting, spring force upon the ornaments when they are compressed to conform to the sides of the rear portion. However, as contemplated with the other described embodiments, according to this invention, a direct compression between upper and lower retaining plates can also be utilized in which no substantially radially-acting force is generated. The shape-conforming action of the elastically-deformed plates according to this invention is often sufficient to maintain the ornaments at a predetermined position within the structure.

The foregoing has been a detailed description of a preferred embodiment. Various modifications and additions can be made without departing from the spirit and scope of this invention. For example, the retaining pin is described herein can be formed integrally as part of the retaining plates. In addition, the ornament assembly can be non-circular, and can define a semicircle or part of a polygon. This description is, therefore, meant to be taken only by way of example and not to otherwise limit the scope of the invention.

What is claimed is:

1. A joining device for chandelier ornaments comprising:

a first ornament having a first mounting hole;

a first retaining plate engaging the first ornament adjacent the first mounting hole on a first side of the first ornament;

a second retaining plate engaging each of the first ornament adjacent the first mounting hole on a second side of the first ornament;

a first projection interconnected with at least one of the first retaining plate and the second retaining plate and engaging the first mounting hole; and wherein the first retaining plate comprises a spring material and the first retaining plate is in a deformed state wherein the first retaining plate exerts a spring force on the first ornament to forcibly retain the first ornament in a predetermined orientation relative to the first retaining plate and the second retaining plate.

2. The joining device as set forth in claim 1 wherein at least one of the first retaining plate and the second retaining plate define a plurality of arms and wherein each of the plurality of arms is constructed and arranged to receive an ornament with a respective mounting hole of each of the ornaments adjacent respective of each of the arms.

3. The joining device as set forth in claim 2 further comprising a securing member located at the center and maintaining the first retaining plate in a deformed state relative to the second retaining plate.

4. The joining device as set forth in claim 1 wherein the projection comprises a pin that engages each of the first retaining plate and the second retaining plate and is located through the mounting hole.

5. The joining device as set forth in claim 4 wherein the pin includes a deformed tip adjacent one of the first retaining plate and the second retaining plate and a head adjacent the other of the first retaining plate and the second retaining plate that maintain the pin relative to the first retaining plate and the second retaining plate.

6. The joining device as set forth in claim 1 wherein the second retaining plate comprises a spring material and the second retaining plate is in a deformed state wherein the second retaining plate exerts a spring force on the first ornament to forcibly retain the first ornament in a predetermined orientation relative to the first retaining plate and the second retaining plate.

7. The joining device as set forth in claim 1 wherein the second retaining plate comprises a substantially rigid material that is substantially free of flexure upon application of the spring force by the first retaining plate on the first ornament.

8. A joining device for chandelier ornaments comprising:

a first plate and an opposing second plate, at least one of the first plate and the second plate comprising a spring material;

an array of chandelier ornaments, the first plate and the second plate capturing the chandelier ornaments in a predetermined array wherein a portion of each ornament is engaged by and captured between the opposing first plate and second plate; and wherein at least one of the first plate and the second plate is deformed to conform to a surface of each of the ornaments and apply stored spring force to each of the ornaments to maintain each of the ornaments in the predetermined array.

9. The joining device as set forth in claim 8 wherein at least one of the first plate and the second plate includes a plurality of arms corresponding to each of the ornaments in the array of ornaments and wherein each of the arms engages a respective of each of the ornaments.

10. The joining device as set forth in claim 8 further comprising a securing member that secures each of the first plate and the second plate relative to each other wherein at least one of the first plate and the second plate is compressed and deformed to conform to the surface of each of the array of ornaments and applies spring force to each of the array of ornaments.

11. The joining device as set forth in claim 8 wherein at least one of the first plate and the second plate includes a projection that engages a mounting hole in at least one of the array of ornaments to restrain the ornaments against radial movement away from a center of at least one of the first plate and the second plate.

12. The joining device as set forth in claim 11 wherein the projection comprises a pin that engages each of the first plate, the second plate and the mounting hole.

13. The joining device as set forth in claim 8 wherein each of the first plate and the second plate include a center and wherein each of the first plate and the second plate apply a force to at least one of the ornaments in an approximately radially-outward direction relative to the center and further comprising a stop on at least one of the first plate and the second plate that engages a portion of the ornament to restrain the ornament against radially-outward movement.

14. A method for joining chandelier ornaments comprising:

locating a first ornament adjacent each of a first retaining plate and a second retaining plate;

elastically deforming the first retaining plate in engagement with the first ornament, the step of elastically deforming including compressing the first retaining plate relative to the second retaining plate to conform the first retaining plate to a shape of at least a portion of the first ornament and to apply a resultant spring force to the first ornament;

securing the first retaining plate relative to the second retaining plate in an elastically-deformed state to secure the first ornament; and retaining the first ornament against slidable movement relative to the first retaining plate and the second retaining plate.

15. The method as set forth in claim 13 wherein the step of retaining includes locating a projection that engages at least one of the first retaining plate and the second retaining plate into a mounting hole on the first ornament.

16. The method as set forth in claim 14 wherein the step of locating includes locating each of the first ornament and a second ornament adjacent respective arms of the first retaining plate and wherein the step of elastically deforming includes deforming a portion of each of the arms.

17. The method as set forth in claim 14 wherein the step of securing includes providing a central hole in each of the first retaining plate and the second retaining plate and locating a securing member through the hole in each of the first retaining plate and the second retaining plate.

18. The method as set forth in claim 1 7 wherein the step of securing further comprises permanently deforming ends of the securing member subsequent to passing the securing member through the central hole in each of the first retaining plate and the second retaining plate.

19. The method as set forth in claim 14 further comprising elastically deforming the second retaining plate by applying a compression force between the first retaining plate and the second retaining plate so that the second retaining plate conforms to the shape of the first ornament and applies a spring force to the first ornament.

20. The method as set forth in claim 14 further comprising providing arms having a predetermined length and a predetermined width and locating each of the first ornament and a second ornament adjacent each of the arms, wherein the step of elastically deforming includes elastically deforming a portion of each of the arms to each respectively conform to a shape of each of the first ornament and the second ornament and to apply spring force to each of the first ornament and the second ornament.

21. A multi-trimming ornament assembly for a chandelier constructed by a method comprising the steps of:

forming a first retaining plate from a piece of flat stock spring material having a series of arms that extend radially outward from a center location;

forming a second retaining plate from a piece of flat stock material;

locating a plurality of ornaments between the first retaining plate and the second retaining plate adjacent each of the arms of the first retaining plate;

retaining each of the ornaments relative to each of the first retaining plate and the second retaining plate against radial movement; and compressing the first retaining plate relative to the second retaining plate to elastically deform the first retaining plate and securing the first retaining plate relative to the second retaining plate in an elastically-deformed state wherein a spring force is applied to each of the ornaments by the first retaining plate.

22. A joining device for chandelier ornaments comprising:

a substantially-rigid plate having a first mounting hole;

an elastically-deformable plate having a second mounting hole;

an ornament having a mounting hole; and a pin passing through each of the first mounting hole, the second mounting hole and the ornament mounting hole wherein the elastically deformable plate is in an elastically-deformed state when the pin is passed through each of the first mounting hole, the second mounting hole, and the ornament mounting hole whereby the ornament is restrained in a predetermined orientation relative to the substantially-rigid plate and the elastically-deformable plate.

23. The joining device set forth in claim 22 wherein the substantially-rigid plate and the elastically-deformable plate are located in face-to-face engagement and wherein the first mounting hole and the second mounting holes are offset relative to each other and wherein the pin and each of the first mounting hole and the second mounting hole are sized and arranged so that the first mounting hole and the second mounting hole frictionally resist passage of the pin therethrough.

24. The joining device as set forth in claim 22 wherein the ornament is located between the substantially-rigid plate and the elastically-deformable plate and wherein the substantially-rigid plate and the elastically-deformable plate are fixed to each other with the elastically-deformable plate engaging the ornament in the elastically-deformed state.

* * * * *